US006736533B2

(12) United States Patent
Matsumoto et al.

(10) Patent No.: US 6,736,533 B2
(45) Date of Patent: May 18, 2004

(54) VEHICULAR HEADLAMP

(75) Inventors: Akinori Matsumoto, Shimizu (JP); Naoki Uchida, Shimizu (JP); Satoshi Yamamura, Shimizu (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/407,716

(22) Filed: Apr. 4, 2003

(65) Prior Publication Data

US 2003/0189840 A1 Oct. 9, 2003

(30) Foreign Application Priority Data

Apr. 8, 2002 (JP) ..... 2002-105089

(51) Int. Cl.[7] ..... F21V 11/00
(52) U.S. Cl. ..... 362/539; 362/305; 362/343
(58) Field of Search ..... 362/303, 305, 362/343, 354, 517, 538, 539

(56) References Cited

U.S. PATENT DOCUMENTS 4,686,610 A * 8/1987 Cibie et al. ..... 362/517
6,494,603 B1 * 12/2002 Takada ..... 362/538
2001/0019484 A1 * 9/2001 Schauwecker et al. ..... 362/539

FOREIGN PATENT DOCUMENTS

GB 2 352 802 B 9/2001

* cited by examiner

*Primary Examiner*—Stephen F. Husar
(74) *Attorney, Agent, or Firm*—Koda & Androlia

(57) ABSTRACT

A projector-type vehicular headlamp including a shade partially blocking light reflected by a reflector and a visor-like shield plate attached on the back of the shade. The shade has an opening near the upper edge so as to allow a light distribution pattern to be formed for overhead sign illumination by the light radiated forward through the opening. The visor-like shield plate extends obliquely downward from between the upper edge of the shade and the opening, thus allowing only the reflected light from the lower reflecting area of the reflecting surface to be directed to reach the opening of the shade, and preventing light flux of an overhead sign illuminating light from becoming excessively bright.

3 Claims, 9 Drawing Sheets

VEHICULAR HEADLAMP

BACKGROUND OF THE INVENTION

1. Field of the Invention

The present invention relates to a so-called projector-type vehicular headlamp and more particularly to a vehicular headlamp that performs overhead sign illumination.

2. Prior Art

Generally, in a projector-type vehicular headlamp, light from the light source, which is provided on an optical axis extending in the longitudinal direction of a vehicle, is reflected by a reflector forward (or toward the front) and toward the optical axis, and this reflected light is radiated forward of the lamp through a projection lens provided in front of the reflector.

When such a projector-type vehicular headlamp is constructed for low beam radiation, a shade 6 is employed. More specifically, as seen from FIG. 8, the shade 6 is provided between a projection lens 2 and a reflector 4 so that the shade 6 blocks partially the reflected light from the reflector 4, thus eliminating upwardly radiated light. As a result, a beam is radiated forward in the low beam light distribution pattern P' that has a predetermined cut-off line CL'.

In such a projector-type vehicular headlamp, since the shade 6 almost completely eliminates the upwardly radiated light, it becomes difficult to see the overhead sign OHS provided above the road ahead of the vehicle.

Therefore, as shown in FIG. 9, so as to solve such a problem, a projecting piece 8 is employed in a conventional vehicular headlamp. The projecting piece 8 is provided near the upper edge on the front surface of the shade 6 and extends obliquely downward in the forward direction. With this projecting piece 8, part of the reflected light from the reflector 4 is deflected and reflected upwardly, thus emitting overhead sign illuminating light B' that is directed upward through the projection lens 2.

However, the conventional vehicular headlamps described above have several problems.

Since the overhead sign illuminating light B' is obtained by way of partially reflecting the reflected light from the reflector 4 with the projecting piece 8, only a spot light distribution pattern is formed. It is thus not easy to obtain a light distribution pattern that has a shape and brightness appropriate for illuminating the overhead sign.

In addition, in the above-described conventional vehicular headlamp, since part of the light flux available for forming a low beam light distribution pattern P' is used as the overhead sign illuminating light B', loss of light flux occurs correspondingly.

SUMMARY OF THE INVENTION

Taking the foregoing problems into consideration, it is an object of the present invention to provide a projector-type vehicular headlamp which can obtain, without causing loss of light flux, a light distribution pattern that has a shape and brightness appropriate for overhead sign illumination.

The present invention accomplishes the above object with an improved structure for generating overhead sign illuminating light.

More specifically, the above object is accomplished by a unique structure for a vehicular headlamp of the present invention that includes: a light source which is provided on an optical axis extending in the longitudinal direction of a vehicle, a reflector which reflects light from the light source forward and towards the optical axis, a projection lens which is provided in front of the reflector, and a shade which is provided between the projection lens and the reflector and partially blocks the light reflected by the reflector so as to eliminate upwardly radiated light; and in the present invention, the shade is formed with:

- an opening of a predetermined shape that penetrates through the (thickness of the) shade and is formed the upper edge of the shade, and
- a visor-like shield provided on the back surface of the shade, the visor-like shield extending obliquely downward in the rearward direction from between the upper edge of the shade and the opening.

The specific structure of the "light source" is not particularly limited. The "light source" in the present application refers to a light discharging portion of a discharge bulb, a filament of an incandescent bulb such as a halogen bulb and the like.

The shape of the "opening" is not particularly limited to a particular shape as long as the opening is formed so as to penetrate through the (thickness of the) shade near the upper edge of the shade. The shape of the opening appropriately can be set according to the shape of a target light distribution pattern for overhead sign illumination and the like.

The specific structure of the "visor-like shield plate", including shape, size, etc. is not particularly limited as long as the shield plate is provided on the back surface of the shade and extends obliquely downward in the rearward direction from between the upper edge of the shade and the opening. In addition, the visor-like shield plate can be constructed integrally to the shade or separately from the shade.

As described above, in the vehicular headlamp according to the present invention, a shade is provided between the projection lens and the reflector, so that it blocks part of the light reflected by the reflector and eliminates the upwardly radiated light. The shade has an opening of a predetermined shape that penetrates through the shade, and such an opening is formed near the upper edge of the shade. In addition, a visor-like shield plate that extends obliquely downward in the rearward direction from between the upper edge of the shade and the opening is provided on the back surface of the shade. Because of this structure, the vehicular headlamp of the present invention has several advantages.

First, among the light that is reflected by the reflector and reaches the shade, the light that has reached the opening is radiated forward through the opening. Since the opening is formed near the upper edge of the shade, a light distribution pattern, the shape of which corresponding to that of the opening, is formed at a location appropriate for overhead sign illumination by way of using the light radiated through the opening.

Since the visor-like shield plate that extends obliquely downward in the rearward direction from between the upper edge of the shade and the opening is provided on the back surface of the shade, among the light reflected by the reflector, only that reflected by the lower reflecting area of the reflecting surface is allowed to reach the opening. Thus, light flux radiated forward through the opening is restricted, and light flux of the overhead sign illuminating light is prevented from becoming excessively bright, and glare towards the driver of an oncoming vehicle and the like can be prevented.

As seen from the above, in the projector-type vehicular headlamp of the present invention, a light distribution pattern that has the shape and brightness appropriate for overhead sign illumination can be obtained without causing loss of light flux, and visibility of an overhead sign can be improved.

In the above-described structure, the lower reflecting area of the reflecting surface may have the shape of a normal reflecting surface of a reflector used in projector-type vehicular headlamps. It is, instead, also possible to form at least one reflective element, which reflects light from the light source towards the opening, in an area below the position where the reflecting surface and an imaginary plane that extends downward from the shield plate intersect or meet. This structure has several advantages.

With such a structure of the present invention, since the visor-like shield plate is provided, a reflecting area (i.e. a reflecting area in which the reflected light is not directed forward over the shade) that makes no contribution to the formation of the low beam light distribution pattern can be formed within the lower reflecting area of the reflecting surface. Moreover, such a reflecting area can have a reflecting surface shape that is formed only with a consideration of overhead sign illumination.

Thus, with at least one reflective element that reflects light from the light source towards the opening and is formed in an area below the intersection position of the reflecting surface and an imaginary plane that extends downward from the shield plate, a light distribution pattern that has a light intensity distribution appropriate for overhead sign illumination is obtained, and the visibility of an overhead sign is considerably improved.

Furthermore, by way of forming a plurality of diffuse reflective elements in the peripheral area of the reflective element on the reflecting surface, the ratio of the reflected light (among the reflected light from the peripheral area) which is radiated forward through the opening becomes smaller. Accordingly, unnecessary expansion of the light distribution pattern for overhead sign illumination by the reflected light from such a peripheral area is prevented, and as a result, the generation of glare light is prevented.

DETAILED DESCRIPTION OF THE INVENTION

Hereafter, preferred embodiments of the present invention will be described with reference to the accompanying drawings.

Figure 1:
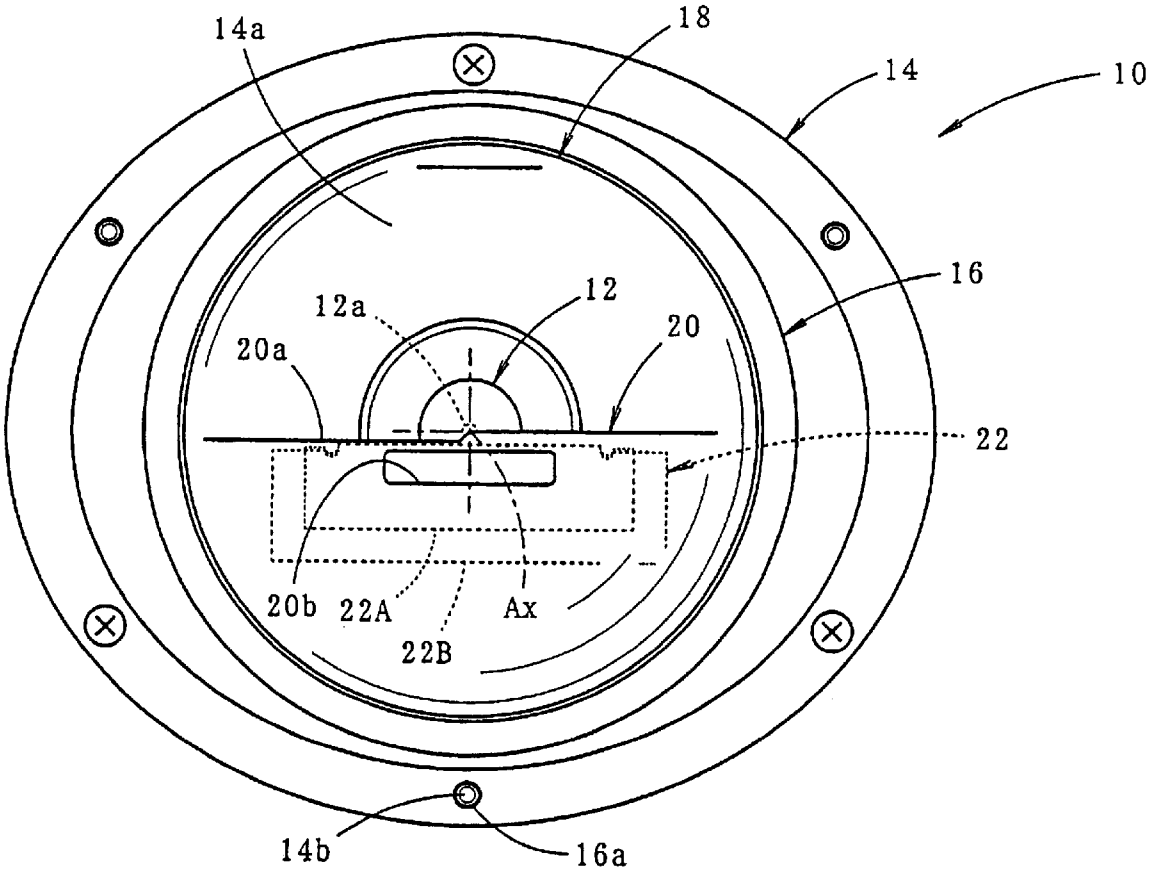
FIG. 1 is a front elevational view of one embodiment of the vehicular headlamp according to the present invention.
Figure 2:
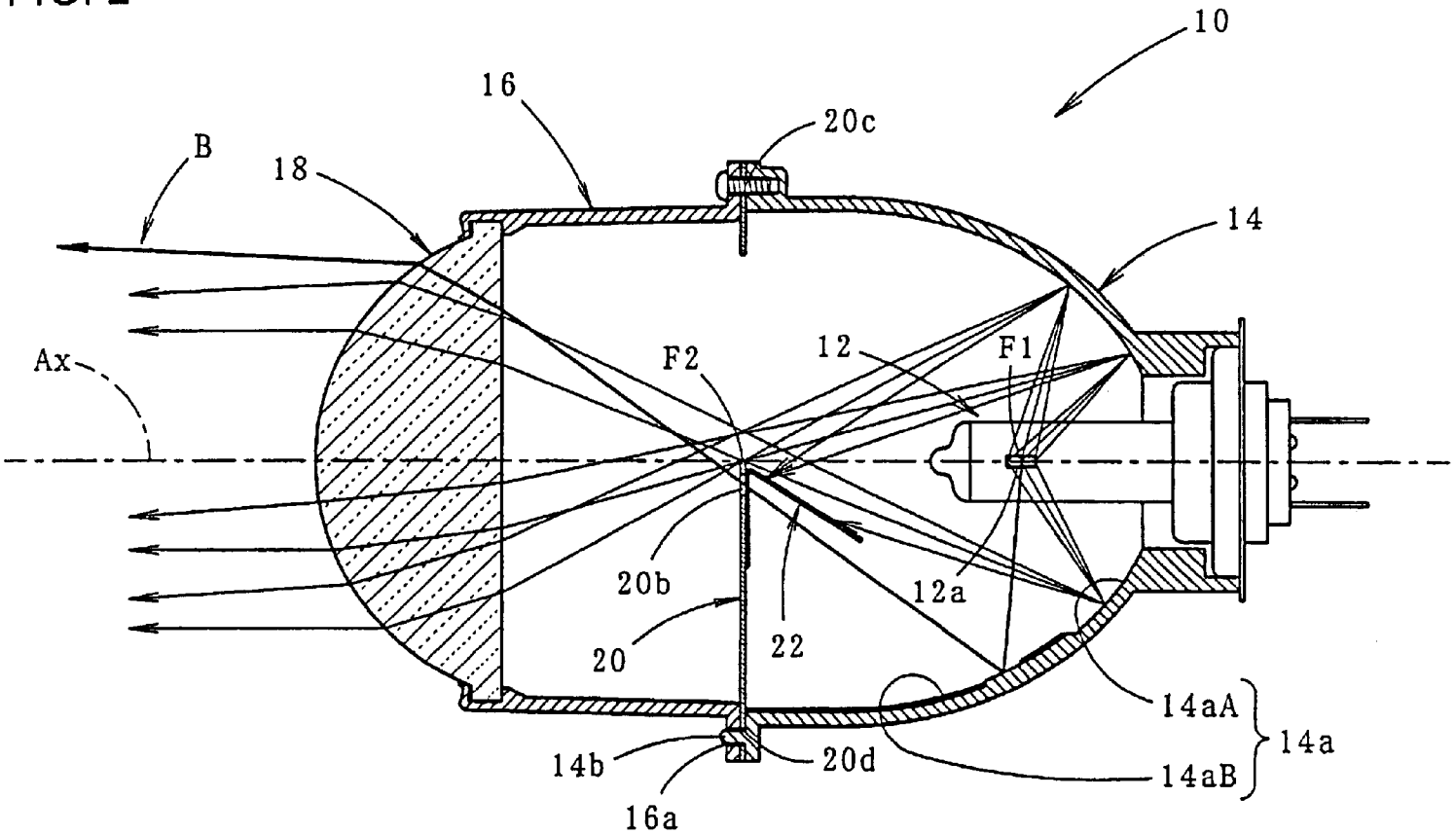
FIG. 2 is a vertical cross-sectional view of the vehicular headlamp of FIG. 1.
Figure 7:
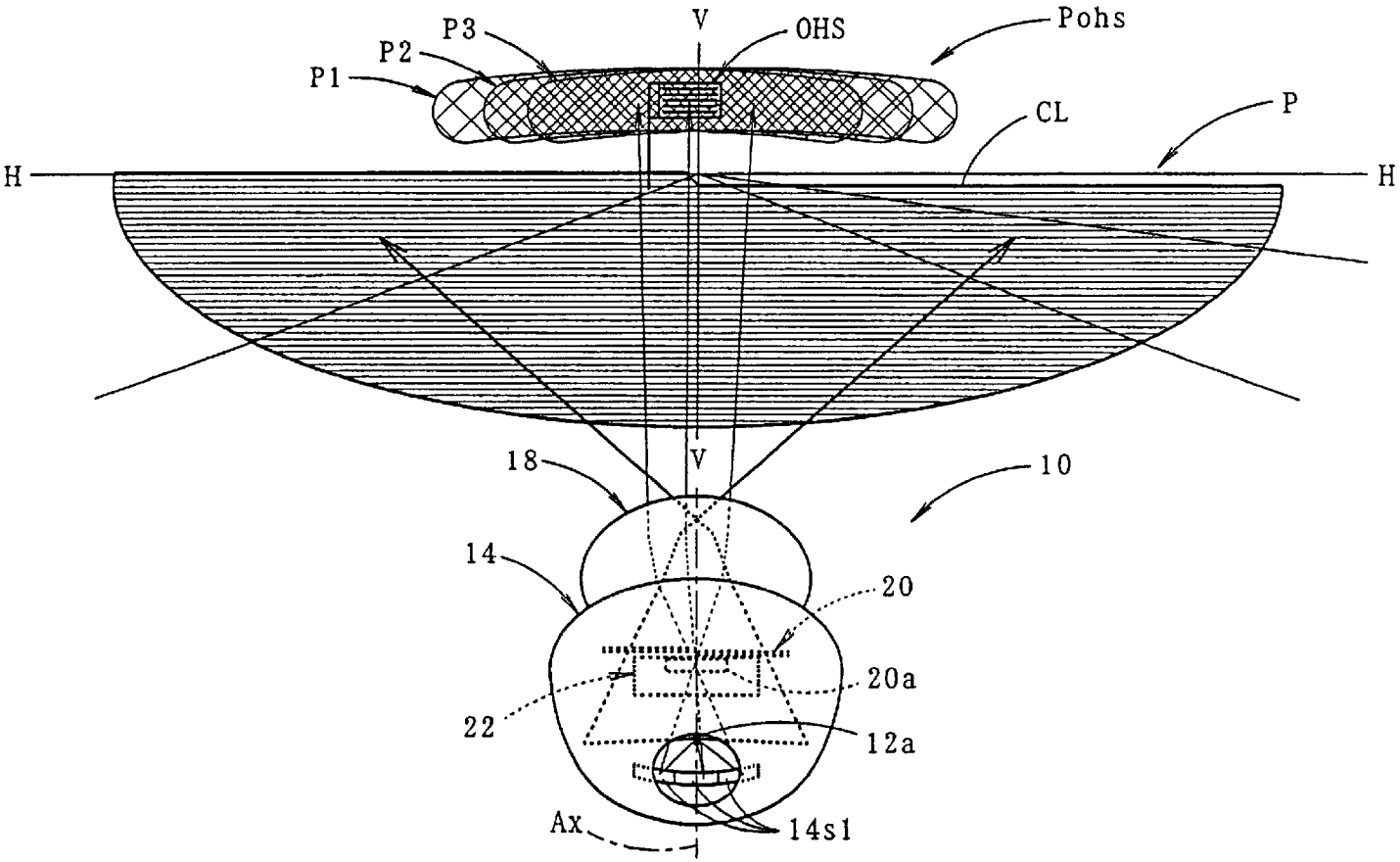
FIG. 7 illustrates, together with the vehicular headlamp viewed from the back side, the low beam light distribution pattern and the light distribution pattern, for overhead sign illumination formed, on a virtual vertical screen located at a position 25 m in front of the lamp, by a beam radiated forward from the vehicular headlamp according to the present invention.
Figure 8:
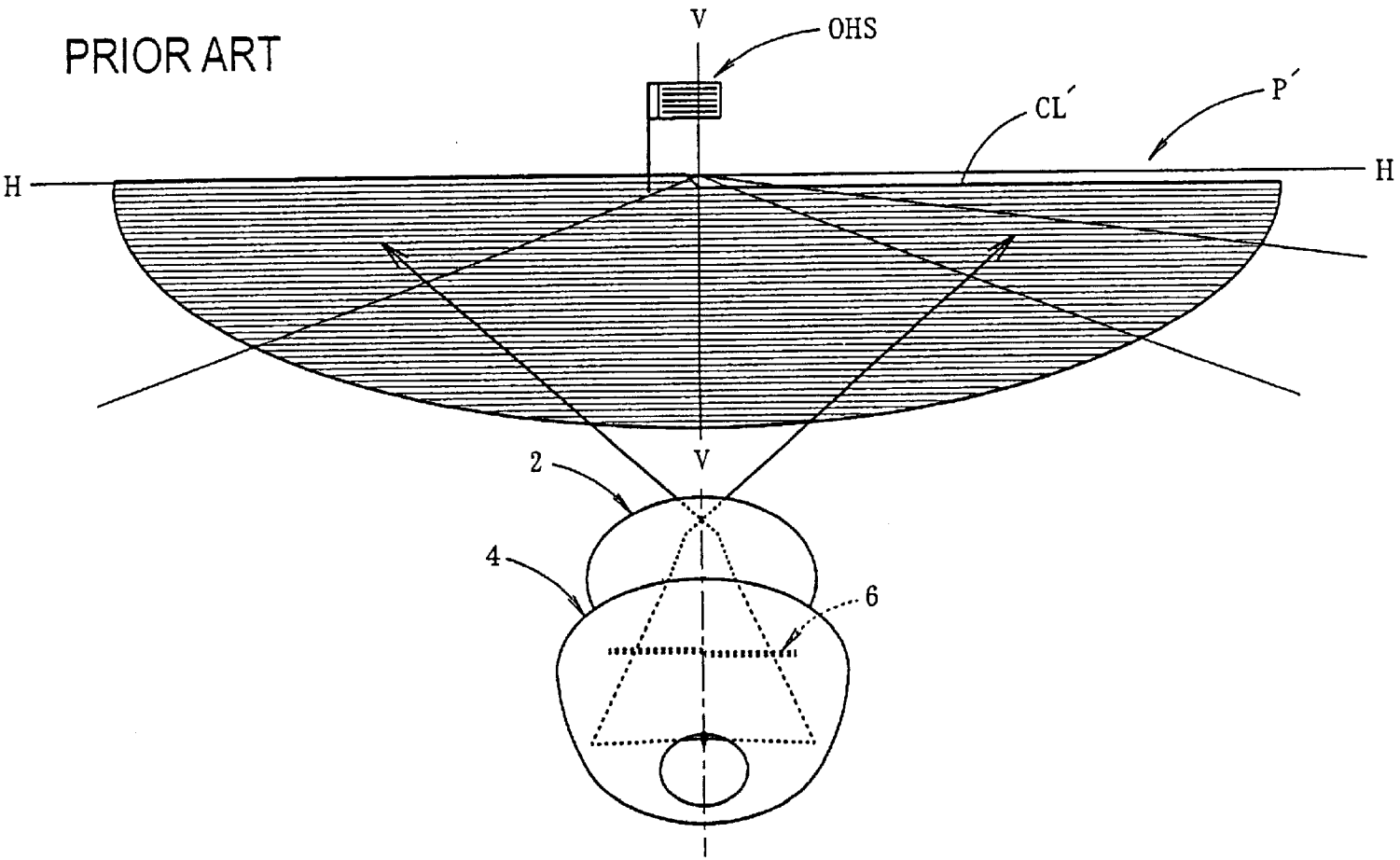
FIG. 8 PRIOR ART
FIG. 8 illustrates such light distribution patterns formed by conventional vehicular headlamp.
Figure 9:
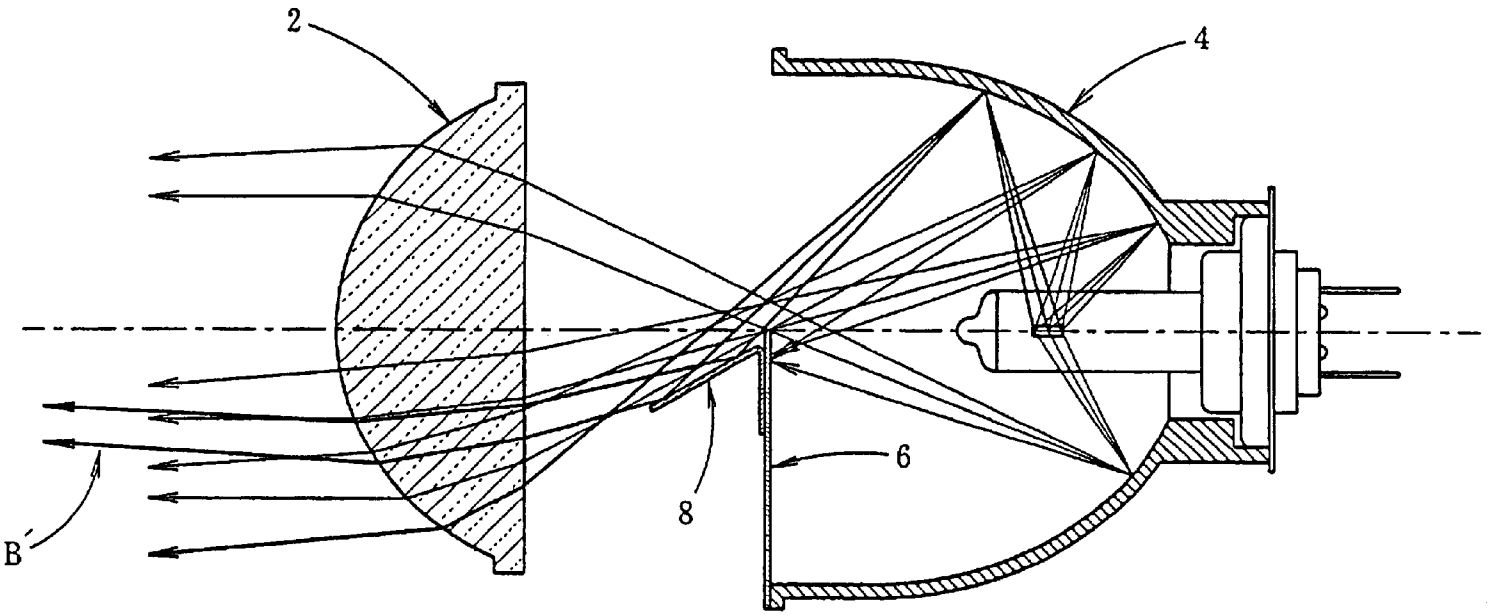
FIG. 9 PRIOR ART
FIG. 9 illustrates such light distribution patterns formed by another conventional vehicular headlamp.

As shown in FIGS. 1 and 2, the vehicular headlamp 10 is a projector-type vehicular headlamp, and it radiates forward a beam in a low beam light distribution pattern P (to be described later) to which a light distribution pattern Pohs for overhead sign illumination such as one shown in FIG. 7 is additionally formed.

The vehicular headlamp 10 includes a light source bulb 12, a reflector 14, a holder 16, a projection lens 18, a shade 20, and a visor-like shield plate 22.

The light source bulb 12 is a so-called H7 halogen bulb, and it is attached to the reflector 14 such that the filament 12*a* (the light source) of the light source bulb 12 is arranged coaxially with an optical axis Ax that extends in the longitudinal direction of a vehicle (more accurately, the light source bulb 12 is arranged in a direction downward by approximately 0.5 to 0.6 degrees with respect to the longitudinal direction of the vehicle).

The reflector 14 has a generally ellipsoid spherical reflecting surface 14*a* of which central axis is the optical axis Ax. The reflecting surface 14*a* is configured such that the shape of the cross section, including the optical axis Ax, of a general reflecting area 14*a*A of the reflecting surface 14*a*, except the lower reflecting area 14*a*B (to be described later), is formed in an ellipsoid shape, and the eccentricity of reflecting surface 14*a* gradually increases from the vertical cross section towards the horizontal cross section. However, the rear side apexes of the ellipses that form these cross-sections are set at the same position. The light source 12*a* is arranged at a first focal point F1 of the ellipse that forms the vertical cross section of the reflecting surface 14*a*. With the structure described above, the reflecting surface 14*a* reflects light from the light source 12*a* forward and towards the optical axis Ax. In this case, such light substantially converges at a second focal point F2 of the ellipse in the vertical cross section that includes the optical axis Ax.

The holder 16 is in a cylindrical shape and extends forward from the front end opening of the reflector 14. The holder 16 is screwed and fixed to the reflector 14 at multiple locations at its rear end portion. A plurality of locating pins 14*b* formed on the front end of the reflector 14 are inserted into a plurality of pin insertion holes 16*a* formed on the rear end portion of the holder 16, and the optical axis of the holder 16 is thus aligned with that of the reflector 14.

The projection lens 18 is fixedly supported at the front end portion of the holder 16. The projection lens 18 is a planoconvex lens. The front side is a convex surface, and the rear side is flat. The projection lens 18 is arranged such that the position of the rear side focal point thereof coincides with the second focal point F2 of the reflecting surface 14*a* of the reflector 14. Accordingly, the projection lens 18 converges the reflected light from the reflecting surface 14*a* of the reflector 14 towards the optical axis Ax so that the light passes through the projection lens 18.

The shade 20 is provided between the reflector 14 and the holder 16. The shade 20 blocks part of the reflected light from the reflecting surface 14*a* of the reflector 14 so as to eliminate upwardly radiated light. More specifically, the shade 20 is provided so as to extend substantially along the vertical plane orthogonal to the optical axis Ax and is arranged such that its upper edge 20*a* that extends in the horizontal direction and has a level difference on left and right sides thereof passes the second focal point F2, thus eliminating upwardly radiated light emitted from the projection lens 18 by way of blocking part of the light reflected by the reflecting surface 14*a* of the reflector 14. As a result, radiated light for low beam that is radiated downward with respect to the optical axis Ax is obtained.

The shade 20 is formed by a sheet metal, and it is securely held together with and fixed between the holder 16 and the reflector 14 when the holder 16 is screwed to the reflector 14. For this construction, the outer peripheral portion of the shade 20 is, as best seen from FIG. 3., provided with a plurality of screw insertion holes 20*c* and locating pin insertion holes 20*d*. When screwing the holder 16 to the reflector 14, the locating pins 14*b* of the reflector 14 are inserted through the locating pin insertion holes 20*d*, thus assuring an optical axis alignment of the shade 20 and the reflector 14.

Furthermore, the shade 20 is formed, near its upper edge, with an opening 20*b*. The opening 20*b* is oblong in the horizontal direction and is generally shaped in rectangular, and it penetrates through the thickness of the shade 20. The visor-like shield plate 22 is attached to the back surface of the shade 20.

Figure 3:
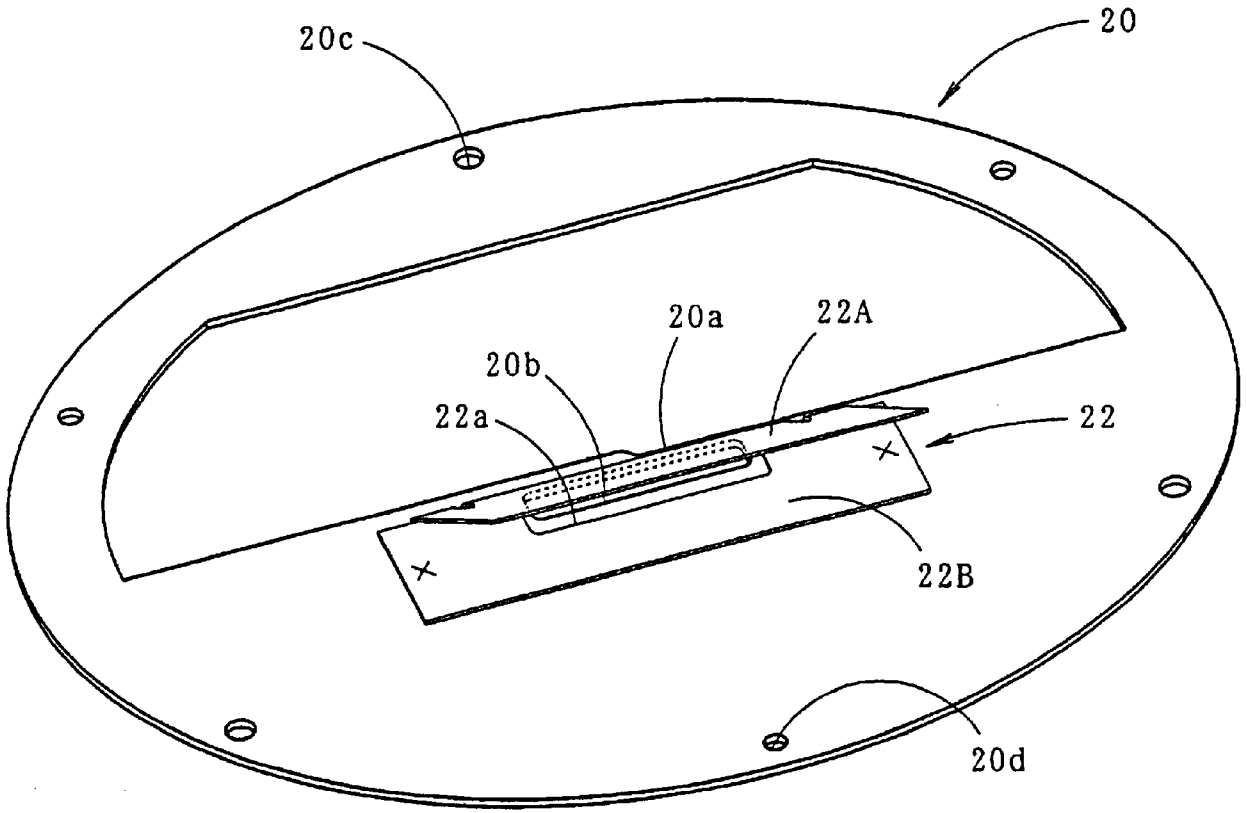
FIG. 3 is an enlarged perspective view of the shade of the vehicular headlamp with a visor-like shield plate provided thereon.

FIG. 3 shows the shade 20 with the visor-like shield plate 22 attached.

As seen from FIG. 3, the visor-like shield plate 22 is formed by punching and bending a sheet metal that has a sheet thickness smaller than the shade 20. The visor-like shield plate 22 is comprised of a main unit portion 22A and a supporting portion 22B. The main unit portion 22A extends obliquely downward in the rearward direction from between the upper edge 20*a* of the shade 20 and the opening 20*b*, and the supporting portion 22B extends downward along the back surface of the shade 20.

Figure 4:
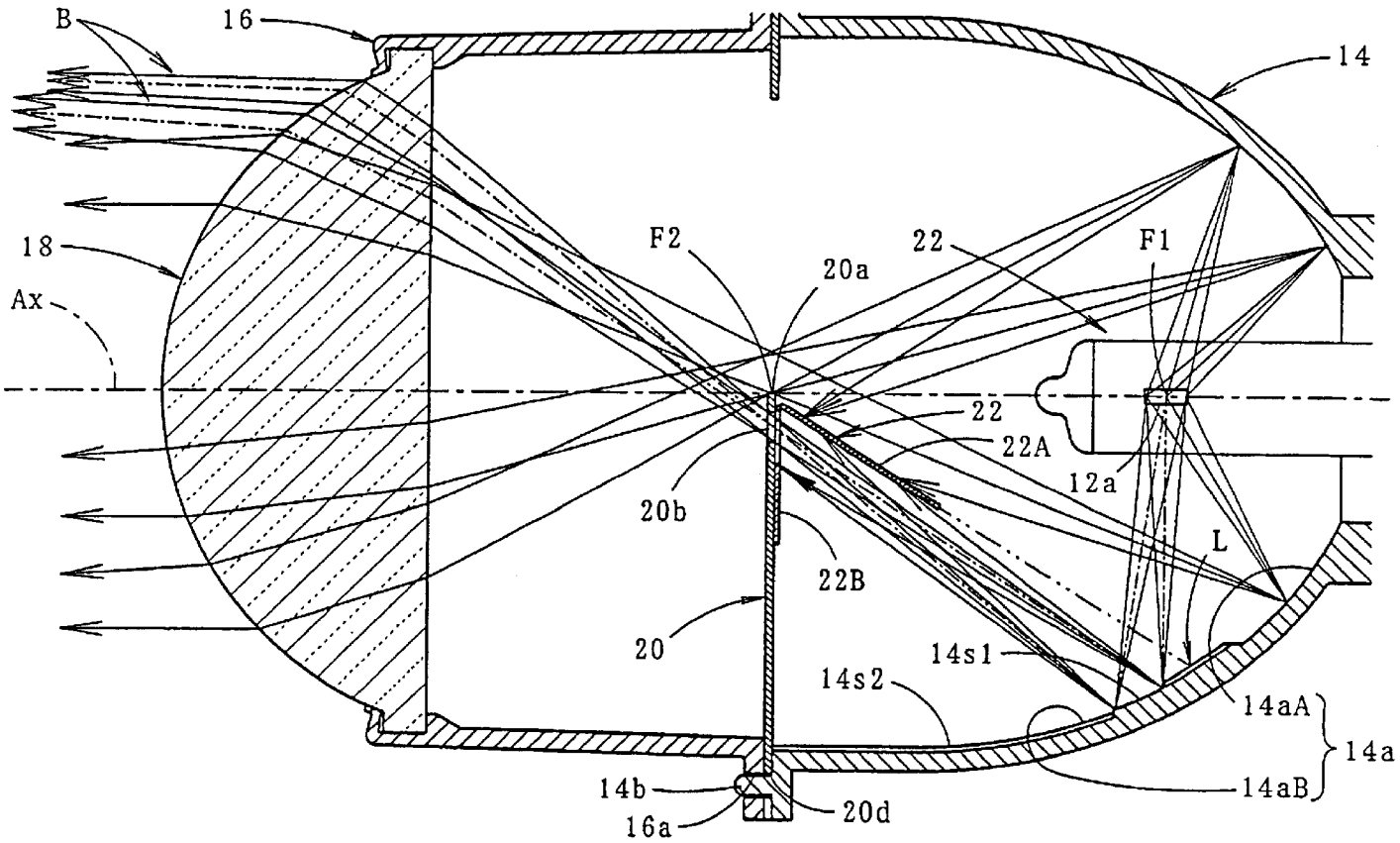
FIG. 4 is a detailed view of the main portion of the structure of FIG. 2.

As best seen from FIG. 4, the downward inclination angle of the main unit portion 22A of the visor-like shield plate 22 is set to approximately 30 to 35 degrees, and its rearward protrusion length is set to approximately 15 to 25 mm. The lateral width of the main unit portion 22A is, as best seen from FIG. 5, set to be larger to some extent than the lateral width of the opening 20*b* of the shade 20.

The lateral width of the supporting portion 22B of the visor-like shield plate 22 is set to be larger to some extent than the lateral width of the main unit portion 22A. The supporting portion 22B is fixed at both ends to the shade 20 by spot welding or other means. An opening 22*a* that is larger than the opening 20*b* of the shade 20 is formed on the supporting portion 22B so as to surround the opening 20*b*.

Figure 5:
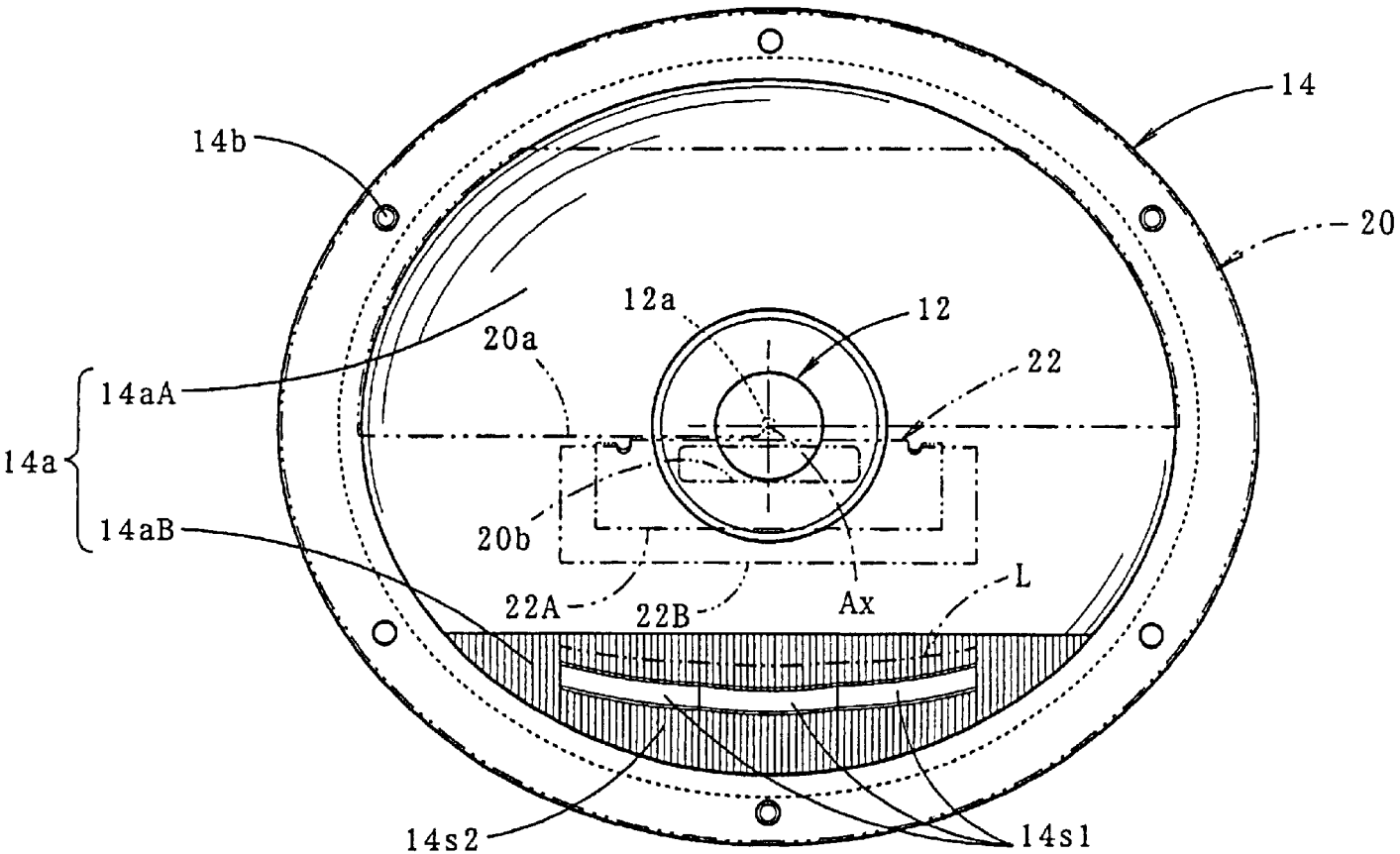
FIG. 5 is a front elevational view of the reflector of the vehicular headlamp with a light source bulb attached.

FIG. 4 shows the detail of the main portion of the structure shown in FIG. 2, and FIG. 5 shows the reflector 14 with the light source bulb 12 attached.

As seen from FIGS. 4 and 5, the reflecting surface 14*a* of the reflector 14 is divided into a general reflecting area 14*a*A and a lower reflecting area 14*a*B, bordering the position that is slightly above the intersection position L with respect to an imaginary plane that extends angularly downward from the visor-like shield plate 22. The basic surface form of the lower reflecting area 14*a*B is substantially the same as the general reflecting area 14*a*A; however, the detailed form thereof differs from the general reflecting area 14*a*A.

More specifically, an area slightly below the intersection position L in the lower reflecting area 14*a*B is provided with a plurality of reflective elements 14*s*1 (three in the shown embodiment as best seen from FIG. 5) that reflect light from the light source 12*a* toward the opening 20*b* of the shade 20. The reflective elements 14*s*1 are arranged side by side in a row. Furthermore, in another portion of the lower reflecting area 14*a*B (i.e., the peripheral area of the three reflective elements 14*s*), a plurality of diffuse reflective elements 14*s* 2 are formed in a knurled (corrugated) pattern.

As seen from FIG. 4, part of the light from the light source 12*a* that is reflected by the general reflecting area 14*a*A is directed towards the opening 20*b* of the shade 20 but does not reach the opening 20*b* because all the light directed towards the opening 20*b* is blocked by the main unit portion 22A of the visor-like shield plate 22.

On the other hand, among the light from the light source 12*a* that is reflected by the lower reflecting area 14*a*B, the light reflected by each reflective element 14*s*1 enters the opening 20*b*, whereas the light reflected by each diffuse reflective element 14*s*2 hardly reaches the opening 20*b* because such light widely diffuses to the left and right.

Figure 6:
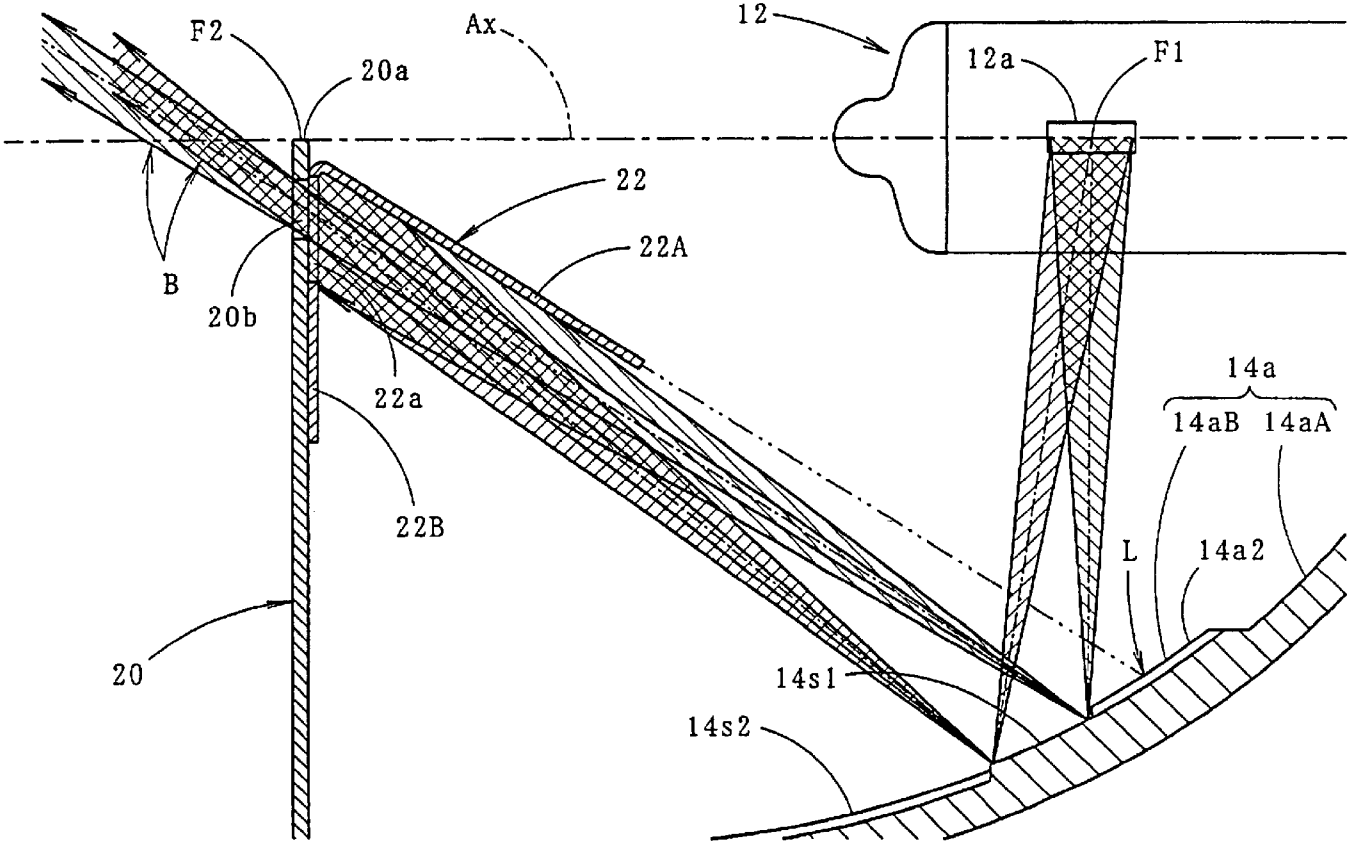
FIG. 6 is a detailed view of the main portion of the structure of FIG. 4.

As seen from FIG. 6 that shows the detail of the main portion of the structure of FIG. 4, all of the reflected light from each reflective element 14*s*1 also does not necessarily reach the opening 20*b* of the shade 20. More specifically, only the reflected light from the central portion of the light source 12*a* reaches the opening 20*b*, and the reflected light from other portions of the light source 12*a* is blocked by the main unit portion 22A or the supporting portion 22*b* of the visor-like shield plate 22, or the peripheral portion of the opening 20*b* of the shade 20. As a result, the light radiated forward through the opening 20*b*, i.e. the overhead sign illuminating light B, has a highly stabilized directionality.

FIG. 7 illustrates, together with the vehicular headlamp 10 viewed from its back side, the low beam light distribution pattern P and the light distribution pattern Pohs for overhead sign illumination that are formed, on a virtual vertical screen installed 25 m in front of the lamp, by a beam radiated forward from the vehicular headlamp 10.

The low beam light distribution pattern P is a low beam light distribution pattern with a left-side light distribution, and it has, on its upper edge, a horizontal cut-off line CL having a level difference on the left and right sides.

More specifically, the horizontal cut-off line CL that has a level difference is formed such that, with respect to H-V (directly ahead of the lamp), the left side of the cut-off line CL (host vehicle lane side) is set at substantially the same position as the line H—H (a horizontal line intersecting H-V) as an upper level portion, and the right side of the cut-off line CL (oncoming lane side) is set at a position slightly below (approximately 0.5 to 0.6 degrees below) the line H—H as a lower level portion.

The light distribution pattern Pohs for overhead sign illumination is formed above and near the line H—H while extending in the lateral direction, so that the overhead sign OHS ahead of the road on which the vehicle is traveling is adequately illuminated. More specifically, the light distribution pattern Pohs is formed with a vertical width of approximately 3 to 4 degrees and a lateral diffusion angle (overall width) of approximately 20 to 25 degrees, having a position approximately 3 degrees above H-V as a center.

The light distribution pattern Pohs is configured as a synthetic light distribution pattern of three light distribution patterns P1, P2 and P3 that are formed by three reflective elements 14*s*1 of the reflector 14. The light distribution patterns P1, P2 and P3 are respectively oblong in the horizontal direction, and the shape of each pattern corresponds to that of the opening 20*b* of the shade 20. In this case, since only the reflected light from the central portion of the light source 12*a* is used as the overhead sign illuminating light B, each of the light distribution pattern P1, P2 and P3 has a substantially homogeneous light intensity distribution. Furthermore, the light distribution patterns P1, P2 and P3 are synthesized in a horizontally offset manner, and thus the light distribution pattern Pohs has a more homogeneous light intensity distribution except at the left and right end portions thereof.

As described above in detail, in the vehicular headlamp 10 of the shown embodiment, the shade 20 is provided between the projection lens 18 and the reflector 14 and blocks part of the reflected light from the reflector 14 so as to eliminate upwardly radiated light. In addition, the opening 20*b* oblong in the horizontal direction and generally shaped in rectangle which penetrates through the (thickness of the) shade 20 is formed near the upper edge of the shade 20, and the visor-like shield plate 22 which extends obliquely downward in the rearward direction from between the upper edge 20*a* and the opening 20*b* of the shade 20 is provided on the back surface of the shade 20. Accordingly, the vehicular headlamp 10 has effects as described below.

First, in the vehicular headlamp 10, among the reflected light from the reflector 14 that reaches the shade 20, the light that has reached the opening 20*b* is radiated forward through the opening 20*b* of the shade 20. Since the opening 20*b* is formed near the upper edge of the shade 20, the radiated light from the opening 20*b* forms the light distribution pattern Pohs that has a shape corresponding to that of the opening 20*b* at a position appropriate for illuminating the overhead sign OHS.

The shade 20 has on its back the visor-like shield plate 22 that extends obliquely downward in the rearward direction from between the upper edge 20*a* of the shade 20 and the opening 20*b*. Accordingly, only the reflected light from the lower reflecting area 14*a*B of the reflecting surface 14*a*, among the light reflected by the reflector 14, reaches the opening 20*b*. Since the light flux radiated forward through the opening 20*b* is thus restricted, and the light flux of the overhead sign illuminating light does not become excessively bright, glare towards a driver of an oncoming vehicle can be prevented.

As seen from the above, the light distribution pattern Pohs having a shape and brightness appropriate for illumination of the overhead sign OHS is obtained without causing loss of light flux.

Furthermore, a plurality of reflective elements 14*s*1 (three in the shown embodiment) that reflect the light from the light source 12*a* toward the opening 20*b* are formed in the area below the intersection position L, which is an intersection of the reflecting area 14*a*B of the reflecting surface 14*a* and an imaginary plane that extends downward from the shield plate 22. This structure provides the effects as described below.

Since the light source 12*a* is a segmented light source that has a predetermined length, if the light from the light source 12*a* is reflected from each reflective element 14*s*1 so as to be directed towards the opening 20*b*, part of the reflected light tends to head upward over the upper edge 20*a* of the shade 20.

In the structure of the embodiment described above, however, the visor-like shield plate 22 is provided, and each reflective element 14*s*1 is formed below the intersection position L. Accordingly, the reflected light, which is directed upward over the upper edge 20*a* of the shade 20 and from the reflective element 14*s*1, is blocked by the visor-like shield plate 22.

As a result, the shape of the reflecting surface of each reflective element 14*s*1 can be formed into a shape that is obtained with only the illumination of overhead sign into consideration, and this can be done without considering the effect on the low beam light distribution pattern P at all. Accordingly, the light distribution pattern Pohs that has a light intensity distribution appropriate for illuminating the overhead sign OHS can be obtained.

In addition, in the above embodiment, the plurality of diffuse reflective elements 14*s*2 are formed in the peripheral area of the three reflective elements 14*s*1 in the reflecting surface 14*a* (a portion other than the three reflective elements 14*s*1 in the lower reflecting area 14*a*B). Thus, among the reflected light from the peripheral area, those radiated forward through the opening 20*b* can be made small in its ratio. As a result, unnecessary expansion of the light distribution pattern Pohs for overhead sign illumination by the reflected light from the peripheral area is prevented, and generation of glare light is also prevented.

Furthermore, in the shown embodiment, since the reflector 14 has three reflective elements 14*s*1 which are for overhead sign illumination, the light distribution pattern Pohs can be formed as a synthesized light distribution pattern that comprise three light distribution patterns P1, P2 and P3 formed by the reflective light from the three reflective elements 14*s*1. Accordingly, the light intensity distribution of the main portion (the portion excluding the left and right end portions) of the light distribution pattern Pohs can be made further uniform, and thus the visibility of the overhead sign OHS is further improved.

Moreover, the visor-like shield plate 22 that is formed by a sheet metal is a separate element from the shade 20. Accordingly, a partition between the reflected light for forming the low beam light distribution pattern P and the reflected light for forming the light distribution pattern Pohs for overhead sign illumination can be formed by the thin main unit portion 22A of the visor-like shield plate 22, and it is possible to effectively use the reflected light. In addition, since the visor-like shield plate 22, made of a sheet metal, is a separate element from the shade 20, the shape of the main unit portion 22A can be set relatively arbitrarily. Depending upon the size of the reflector 14, the shape of the opening 20*b* of the shade 20, the specific values of the inclination angle, the rearward protrusion length, the lateral width, and the like of the main unit portion 22A can be set to the values that differ from those described above for the shown embodiment.

In the above embodiment, three reflective elements 14*s*1 are provided side by side in a row. The reflective elements 14*s*1 for overhead sign illumination can be in other arrangements, and it is also possible to form only a single reflective element 14*s*1.

Furthermore, in the above embodiment, the plurality of diffuse reflective elements 14*s*2 are formed in the peripheral area of three reflective elements 14*s*1 on the reflecting surface 14*a*. Instead of this configuration, frosting and graining can be performed, and also non-reflective paint or the like can be applied. In such a case either, the ratio of the reflected light among the reflected light from the peripheral area that is radiated forward through the opening 20*b* can be made small as in the shown embodiment.

Moreover, the shade 20 in the shown embodiment has the upper edge 20*a* that extends in the horizontal direction and has a level difference on the left and right sides thereof, and this structure is employed so as to form the low beam light distribution pattern P that has the horizontal cut-off line CL having a level difference on the left and right sides thereof. Nevertheless, the upper edge 20*a* of the shade 20 can be formed in a different shape than the shown embodiment in order to form the low beam light distribution pattern that has a different cut-off line (for example, a horizontal and oblique cut-off line) than that described above. With such a configuration as well, the same effects as those of the shown embodiment can be obtained.

What is claimed is:

1. A vehicular headlamp comprising a light source that is provided on an optical axis extending in a longitudinal direction of a vehicle, a reflector that reflects light from said light source forward and towards said optical axis, a projection lens that is provided in front of said reflector, and a shade that is provided between said projection lens and said reflector and blocks part of reflected light from said reflector so as to eliminate upwardly radiated light;

wherein said shade is formed with:

an opening of a predetermined shape, said opening penetrating through said shade and being formed at a portion near an upper edge of said shade; and a visor-like shield provided on a back surface of said shade, said visor-like shield extending obliquely downward in a rearward direction from between said upper edge of said shade and said opening.

2. The vehicular headlamp according to claim 1, wherein at least one reflective element that reflects light from said light source towards said opening is formed on a reflecting surface of said reflector, said at least one reflective element being in an area which is below a position where said reflecting surface of said reflector and an imaginary plane that extends downward from said visor-like shield plate intersects.

3. The vehicular headlamp according to claim 2, wherein a plurality of diffuse reflective elements are formed in a peripheral area of said reflective element formed on said reflecting surface.

* * * * *